US007353769B2

(12) United States Patent
Unrast et al.

(10) Patent No.: US 7,353,769 B2
(45) Date of Patent: Apr. 8, 2008

(54) CANTILEVER COVER

(76) Inventors: Robert E. Unrast, 8758 State Route 119, Maria Stein, OH (US) 45860; Leonard R. Holdheide, 1729 Harting Rd., Maria Stein, OH (US) 45860

( * ) Notice: Subject to any disclaimer, the term of this patent is extended or adjusted under 35 U.S.C. 154(b) by 72 days.

(21) Appl. No.: 11/505,454

(22) Filed: Aug. 17, 2006

(65) Prior Publication Data

US 2007/0068634 A1 Mar. 29, 2007

Related U.S. Application Data

(60) Provisional application No. 60/716,534, filed on Sep. 14, 2005.

(51) Int. Cl.
*B63B 17/00* (2006.01)
*E04H 15/04* (2006.01)

(52) U.S. Cl. ..... 114/361; 135/90

(58) Field of Classification Search ..... 114/361
See application file for complete search history.

(56) References Cited

U.S. PATENT DOCUMENTS

| | | | | |
|---|---|---|---|---|
| 2,708,346 A | | 5/1955 | Smith | |
| 3,002,195 A | * | 10/1961 | Prudek | 4/494 |
| 3,083,540 A | | 4/1963 | Smith | |
| 3,895,400 A | * | 7/1975 | Kelcey | 4/500 |
| 4,019,212 A | | 4/1977 | Downer | |
| 4,363,284 A | | 12/1982 | Monroe | |
| 5,086,799 A | | 2/1992 | Lumbleau | |
| 5,573,026 A | | 11/1996 | Griffith | |
| 5,709,501 A | | 1/1998 | Elbers | |
| 5,769,105 A | | 6/1998 | Margol et al. | |
| 6,102,059 A | | 8/2000 | Miller | |
| 6,688,252 B1 | | 2/2004 | Caravella | |
| 6,786,171 B1 | | 9/2004 | Elbers | |
| 6,846,129 B1 | | 1/2005 | Edson | |

OTHER PUBLICATIONS

Website, http://www.automatic-boat-cover.com/Magazines/powerboating.html, Touchless Boat Cover manufactured by Innovative Marine Technologies, printed Jun. 21, 2005, one sheet.

* cited by examiner

*Primary Examiner*—Jesús D Sotelo
(74) *Attorney, Agent, or Firm*—Richard C. Litman

(57) ABSTRACT

The cantilever cover is suspended from one side over an article to be protected from the elements. The cover has a canopy frame and flexible, weatherproof canopy or cover secured thereover. A pair of canopy frame support arms extends from corresponding closed sleeves, which ride up and down upon the vertical support columns of a hoist assembly. Each sleeve includes a pair of diagonally opposed rollers, which bear against opposite sides of its respective column. A single winch (electric, hydraulic, pneumatic, etc.) is mounted centrally upon an upper crossmember extending between the two columns, with opposed equal length cables extending to the two canopy frame support sleeves. A remote control extends down the hoist frame from the winch, for operation of the device. One or more limit switches may be installed to limit the maximum or minimum travel of the canopy frame and cover.

20 Claims, 3 Drawing Sheets

CANTILEVER COVER

CROSS-REFERENCE TO RELATED APPLICATION

This application claims the benefit of U.S. Provisional Patent Application Ser. No. 60/716,534, filed Sep. 14, 2005.

BACKGROUND OF THE INVENTION

1. Field of the Invention

The present invention relates generally to movable protective covers and shelters having rigid frames, and particularly to a cantilever cover including a canopy frame and cover movably extendable from a laterally offset hoist assembly. The cantilever cover is particularly well suited for use as a boat cover when secured to the edge of a dock or the like, or may be used as a carport or patio cover, or the like.

2. Description of the Related Art

The need to provide protection and shelter for various large articles in the outdoor environment is well known. This need may be even more important now than in the past, with people purchasing ever more valuable boats, automobiles, and other vehicles, which are often stored outdoors due to the lack of indoor storage space, and with increasing concerns about acid rain and other atmospheric pollutants, which can damage articles stored outdoors. Boaters have long recognized this problem, and most boats ranging from small outboard fishing boats to larger yachts are generally fitted with a cover when not in use. Larger boats and yachts would certainly benefit from the protection provided by a suitable cover, but the labor involved in the installation and removal of such a cover on a large boat each time the boat is used makes the use of such a cover impractical.

Accordingly, various powered or mechanized devices for raising and lowering a cover over a boat have been developed in the past. Many such covers are associated with boat lifts or similar devices, or completely enclosed boathouses. However, many boat owners are not so fortunate as to have an enclosed boathouse or other structure for protecting their boat or watercraft, with the watercraft being tied up to an open dock for storage during most of its life. While some covers have been developed for boats and other vehicles with no other protection, such covers are generally supported on both sides, i.e., they are not cantilever structures. This is often not practicable for a boat tied up at a dock or slip, where the opposite side of the boat is exposed to open water. This may also be true for other vehicles, e.g., an automobile, boat trailer and boat, etc., stored adjacent a residence.

Thus, a cantilever cover solving the aforementioned problems is desired.

SUMMARY OF THE INVENTION

The cantilever cover comprises a rigid canopy frame having a flexible, weatherproof cover extending thereover. The cover preferably includes a depending skirt, with the hem of the skirt being weighted in order to preclude its blowing up or over the canopy in high winds. The canopy frame is supported by a pair of generally horizontal arms, which extend from corresponding closed sleeves, which, in turn, ride upward and downward on the vertical columns of a hoist assembly. The sleeves include diagonally opposed rollers, which bear against the opposite surfaces of the columns to reduce friction when raising and lowering the canopy assembly. The sleeves are raised and lowered on the columns by a single, central winch, which is secured at the center of a horizontal crossmember extending between the upper ends of the two columns.

Identical first and second cables extend from the winch to each lifting sleeve, to raise and lower the sleeves and attached canopy frame and cover when the winch is actuated. A remote control at one side of the hoist frame is used to control the winch. One or more limit switches may be provided to stop the winch at the upper and/or lower limits of travel for the sleeves and the canopy frame extending therefrom. The winch may be electrically powered from an electric utility grid, generator, or battery power, or may utilize some other operating principle (hydraulic, pneumatic, etc.).

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a cantilever cover having an actuating mechanism for lifting and lowering the cover from one side of the cover. The cantilever cover is particularly well suited for use in covering and protecting a boat moored at a dock or slip, as the cover support and actuating mechanism may be secured to the side of the dock to extend over the boat to the open water side of the slip. It will also be seen that the cantilever cover may be used in other environments, e.g., as a patio cover, carport cover, etc., without a supporting structure opposite the laterally disposed actuating mechanism.

Figure 1:
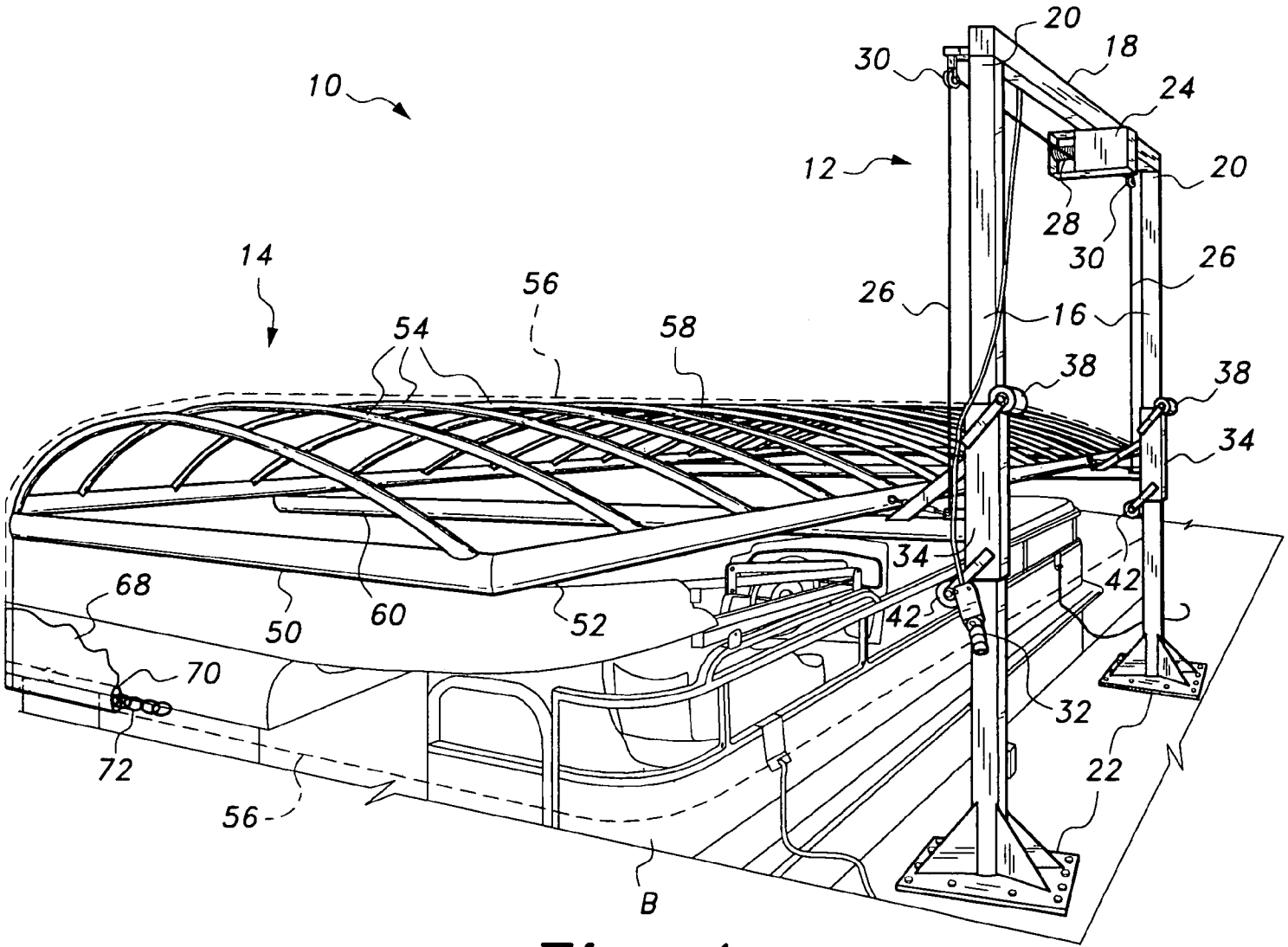
FIG. 1 is an environmental, perspective view of a cantilever cover according to the present invention, showing its general features.
Figure 2:
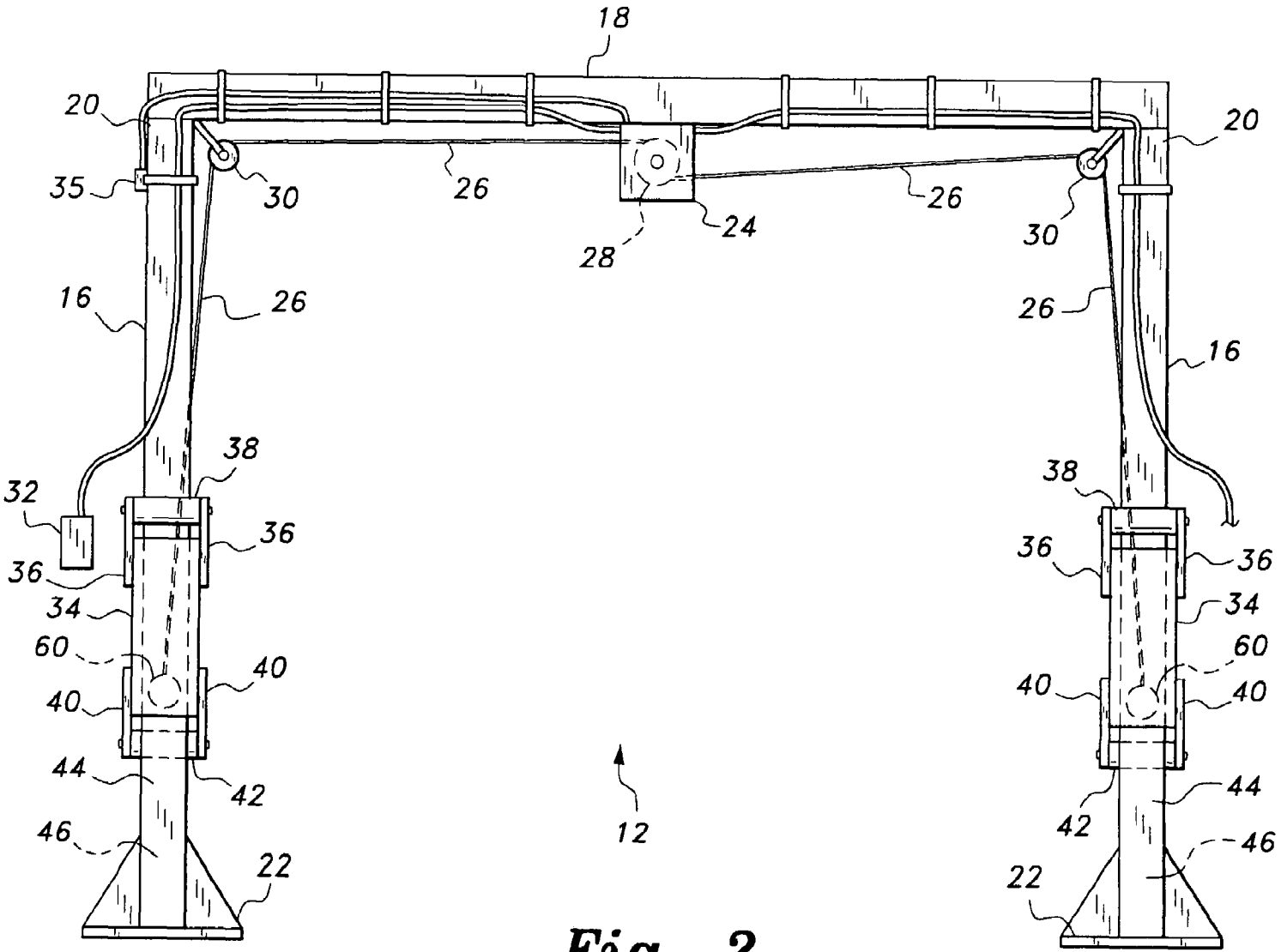
FIG. 2 is a front elevation view of the hoist assembly of the cantilever cover of the present invention, showing various features thereof.
Figure 3:
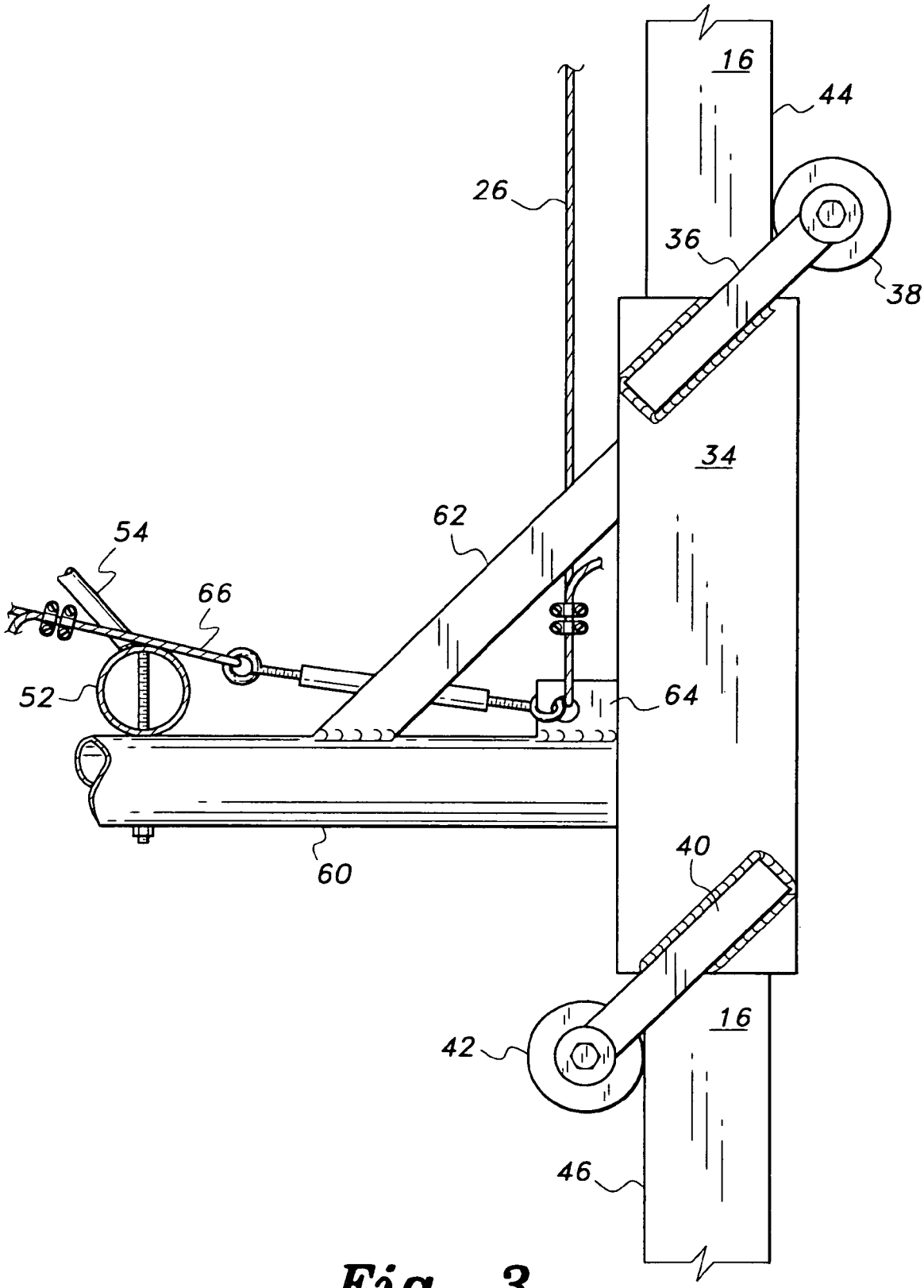
FIG. 3 is a detailed side elevation view of one side of the hoist mechanism of the cantilever cover according to the present invention.

FIG. 1 of the drawings provides a perspective view of the cantilever cover assembly 10 lowered to protect a boat B moored thereunder. FIG. 2 provides an elevation view of the hoist assembly 12 used to lift and lower the canopy frame and cover assembly 14. FIG. 3 illustrates details of the canopy frame attachment to the hoist assembly 12. The hoist assembly 12 of FIGS. 1 and 2 includes a series of posts or vertical columns 16 (two in the example illustrated, although more could be used for larger units), with a horizontal crossmember 18 spanning the upper ends 20 of the columns 16. The crossmember 18 is permanently and immovably secured to the columns 16, to provide a rigid canopy frame support structure. The lower ends of the columns 16 are provided with mounting and/or attachment plates 22 or other structure, which are bolted or otherwise permanently and immovably secured to the underlying dock or other structure.

A single winch 24 is secured to the medial point of the hoist assembly crossmember 18. The central location of the winch 24 allows the two opposed canopy assembly lift cables 26 to be equal in length, thus facilitating fabrication and installation of the cables 26, as no confusion can occur regarding the side to which each cable 26 is to be installed. The two cables 26 are attached to a single reel or spool 28, which is driven by the winch 24 motor. The cables 26 extend in opposite directions generally parallel to the span of the horizontal crossmember 18 to opposed pulleys 30 located at the junctures of the crossmember 18 with the upper ends 20 of the vertical columns 16. From the pulleys 30, the cables 26 extend downward to attach to the canopy lifting apparatus installed on the columns 16, shown in detail in FIG. 3 and discussed further below.

The winch 24 is preferably electrically powered, but a hydraulic or pneumatic winch may be substituted therefor. In the drawings, a remotely located winch actuation control switch 32 is shown connected to the winch 24 by electrical wiring, the winch being powered by an electric motor, so that the switch 32 may be easily accessed from the dock or mounting base for the hoist assembly 12 for operation of the winch as required. It will be understood, however, that the switch may comprise a radio frequency or infrared transmitter communicating with a control unit electrically connected to the winch, or the remote switch may be mounted on or communicate with to a control unit activating a hydraulic or pneumatic winch drive system. The actuating system may also include one or more limit switches, e.g., the upper limit switch 35 shown in FIG. 2, to prevent excessive travel of the canopy lift mechanism on the hoist assembly 12. The limit switch(es) 35 operates conventionally, opening the winch motor drive circuit to stop the winch 24 when some portion of the canopy lifting apparatus comes into contact with the switch(es) 35 at the upper and/or lower limit of travel of the apparatus.

FIG. 3 provides a detailed view of the canopy frame and cover assembly lifting apparatus, which moves or slides vertically along the columns 16. One such apparatus is installed upon each of the vertical columns 16. Each canopy assembly lifting apparatus preferably comprises a canopy frame support sleeve 34, which is installed upon the corresponding vertical column 16 and which slides upwardly and downwardly along its column 16. The sleeves 34 are preferably generally tubular closed structures that surround and enclose their respective columns, excepting the open sleeve ends, to allow passage of the columns 16 therethrough. The use of such closed tubular structures for the canopy frame support sleeves 34 provides additional strength for the units and precludes any possibility of the sleeves 34 springing open due to the bending stresses imposed upon them by the weight of the cantilever canopy frame and cover assembly 14.

Each canopy frame support sleeve 34 includes an upper pair of brackets 36 having a front face sleeve roller 38 mounted therebetween, and a diagonally opposite lower pair of brackets 40 having a back face sleeve roller 42 mounted therebetween. The front and back face rollers 38 and 42 bear against the respective front and back faces 44 and 46 of the vertical column 16 upon which their respective canopy frame support sleeve 34 is installed. Covers (not shown, for clarity in the drawings) may be installed over the rollers 38 and 42 to protect them from the elements, if so desired.

The rigid canopy frame 50, which extends laterally from the canopy lifting apparatus, is shown in perspective in FIG. 1. The canopy frame 50 comprises a peripheral structure 52 having a series of lateral ribs 54 spanning the periphery. The ribs 54 support the overlying canopy 56 (shown in broken lines in FIG. 1, in order to show clearly the underlying canopy frame structure), with the ribs 54 preferably having an elevated central portion 58 in order to raise the central portion of the canopy 56 to promote good runoff of precipitation and the like. The ribs 54 may be smoothly curved, as shown in FIG. 1, or may alternatively form a relatively sharp crest angle to form a gabled configuration when covered.

The canopy frame 50 is, in turn, supported by canopy support arms 60, with each canopy support arm 60 being permanently and immovably affixed (e.g., welded, etc.) to a corresponding one of the canopy frame support sleeves 34. Each canopy support arm 60 preferably comprises an elongate spar that extends from its attachment point to its respective support sleeve 34, completely across and beneath the canopy frame 50 and its peripheral structure 52 to attach to the distal edge or side thereof. Reinforcement of the canopy frame support arm attachment point with its respective support sleeve is provided by a diagonal tension brace 62, with further strengthening provided by a corner gusset 64, which also provides an eye for the attachment of the canopy lift cable 26. Further support for the canopy frame assembly may be provided by tension cables 66 which extend from the lift cable attachment gusset 64 and span the canopy frame assembly 50 beneath the cover 56.

The canopy frame assembly 50 is covered by a flexible canopy cover 56, as noted generally further above. The canopy cover 56 may be formed of any suitable flaccid or flexible sheet material, e.g., conventional plastic tarp material, woven or non-woven fabrics as used in automobile covers, heavier canvas or synthetic fabric material, etc., as desired. Alternatively, relatively thin and rigid or semi-rigid sheet materials could be used, e.g., composite glass fiber or plastic material, aluminum sheet, etc., as desired. However, the use of a flaccid sheet material provides the benefit of a flexible skirt 68 (shown in FIG. 1), which depends around the canopy frame periphery 52, and allows a person to flex or fold the skirt out of the way for access to mooring lines, etc. as required. The skirt 68 preferably includes a closed hem pocket 70, which contains a ballast weight 72 therein (e.g., chain, as shown in FIG. 1, or alternatively steel or lead shot, sand, etc., as desired). The weight 72 stabilizes the canopy skirt 68 and prevents the skirt 68 from blowing up over the edge of the canopy structure in high winds, thereby preventing wind blown water and/or other debris from entering the boat beneath the edge of the canopy cover 56.

In conclusion, the cantilever cover greatly facilitates the installation of a protective cover over a boat or other vehicle or article, where that vehicle or article is consistently stored or parked in a single specific location. The user of the present cover need only actuate the winch motor to wind the canopy lift cables onto the spool or reel of the winch, thereby lifting the canopy frame and its cover upwardly and clear of the boat or other underlying object. The boat/car/or other article is then easily accessed, and may be driven or navigated clear of the cover. When the vehicle or article is returned, the process is reversed, with the user merely actuating the control switch in the opposite direction to lower the canopy over the boat or article once the boat or article has been moored or otherwise secured. The weighted, flaccid hem of the cover allows the owner or user of the boat or vehicle to raise the edge of the lowered cover for a quick check or access, while holding the cover in place during high winds. Accordingly, the present cantilever cover will prove to be a most useful device or accessory for anyone who has need to provide protection for a boat, car, or other article normally stored outdoors.

It is to be understood that the present invention is not limited to the embodiment described above, but encompasses any and all embodiments within the scope of the following claims.

We claim:

1. A cantilever cover, comprising:

a first column and a second column, each of the columns having a lower end adapted for attachment to a support surface and an upper end;

a linear crossmember extending between the upper end of each of the columns parallel to the support surface;

a first sleeve and a second sleeve slidably disposed on the first and second columns, respectively;

a winch centrally mounted on the crossmember;

a first winch cable extending between the winch and the first sleeve and a second winch cable extending between the winch and the second sleeve;

a winch activation switch remotely located from the winch and controlling actuation of the winch;

a canopy frame attached to the first and second sleeves extending lateral to a plane defined by the columns and the crossmember; and a canopy cover attached to the canopy frame.

2. The cantilever cover according to claim 1, wherein each said canopy frame support sleeve comprises a closed tubular structure completely surrounding and enclosing a portion of a corresponding one of said columns.

3. The cantilever cover according to claim 1, further comprising a canopy support arm attached to each of said sleeves, each of the canopy support arm being an elongate spar extending beneath and completely across said canopy frame to each of said canopy frame support sleeves.

4. The cantilever cover according to claim 1, wherein said canopy frame has a raised central area formed by a plurality of laterally disposed ribs, each of the ribs having an elevated central portion.

5. The cantilever cover according to claim 1, wherein said canopy cover further includes a depending skirt having a hem with a flaccid weight disposed therein.

6. The cantilever cover according to claim 1, wherein said winch is electrically powered.

7. The cantilever cover according to claim 1, further including at least one limit switch adapted to shut off operation of said winch at a predetermined point of travel of said canopy assembly relative to said hoist assembly.

8. A cantilever cover, comprising:

a hoist assembly, including;

a plurality of substantially vertical columns, each of the columns having a front face, a back face, and an upper end;

a closed, canopy frame support sleeve slidably disposed upon and enclosing a portion of a corresponding one of the columns;

first and second, diagonally opposed sleeve rollers extending from each of the sleeves, the first roller bearing upon the front face and the second roller bearing upon the back face of a corresponding one of the columns;

a substantially horizontal upper crossmember joining the upper ends of the columns together;

a winch mounted upon the hoist assembly;

a canopy assembly lift cable extending from the winch to each of the canopy frame support sleeves;

a remotely disposed winch actuation control switch extending from the winch;

a canopy assembly, having;

a canopy frame;

a canopy cover removably disposed over the canopy frame; and a canopy support arm extending from the canopy frame to each of the canopy frame support sleeves, permanently and immovably affixing the canopy frame to the canopy frame support sleeves, the canopy support arms extending therefrom in a substantially parallel array.

9. The cantilever cover according to claim 8, wherein:

said winch comprises a single winch mounted centrally upon the upper crossmember of said hoist assembly; and each said canopy assembly lift cable is substantially equal in length to one another.

10. The cantilever cover according to claim 8, wherein each said canopy support arm comprises an elongate spar extending beneath and completely across said canopy frame to each said canopy frame support sleeve.

11. The cantilever cover according to claim 8, wherein said canopy frame has a raised central area formed by a plurality of laterally disposed ribs, each of the ribs having an elevated central portion.

12. The cantilever cover according to claim 8, wherein said canopy cover further includes a depending skirt having a hem with a flaccid weight disposed therein.

13. The cantilever cover according to claim 8, wherein said winch is electrically powered.

14. The cantilever cover according to claim 8, further including at least one limit switch adapted to shut off operation of said winch at a predetermined point of travel of said canopy assembly relative to said hoist assembly.

15. A cantilever cover, comprising:

a hoist assembly, including;

a pair of substantially vertical columns, each of the columns having a front face, a back face, and an upper end;

a canopy frame support sleeve slidably disposed upon each of the columns;

first and second diagonally opposed sleeve rollers extending from each of the sleeves, the first sleeve roller bearing upon the front face and the second sleeve roller bearing upon the back face of a corresponding one of the columns;

a substantially horizontal upper crossmember joining the upper ends of the columns together, the crossmember being permanently and immovably affixed to the columns;

a winch mounted upon the hoist assembly;

a canopy assembly lift cable extending from the winch to each of the canopy frame support sleeves, each of the cables being substantially equal in length to one another;

a remotely disposed winch actuation control switch extending from the winch;

a canopy assembly having;

a canopy frame;

a canopy cover removably disposed over the canopy frame; and an elongate canopy support arm extending beneath and completely across the canopy frame to each of the canopy frame support sleeves.

16. The cantilever cover according to claim 15, wherein said winch comprises a single winch mounted centrally upon the upper crossmember of said hoist assembly, each of said canopy assembly lift cables being substantially equal in length to one another.

17. The cantilever cover according to claim 15, wherein each said canopy frame support sleeve comprises a closed tubular structure completely surrounding and enclosing a portion of a corresponding one of said columns.

18. The cantilever cover according to claim 15, further comprising a plurality of laterally disposed ribs forming a raised central area in said canopy frame, each of the ribs having an elevated central portion.

19. The cantilever cover according to claim 15, wherein said canopy cover further includes a depending skirt having a hem with a flaccid weight disposed therein.

20. The cantilever cover according to claim 15, wherein:

said winch is electrically powered; and said hoist assembly further includes at least one limit switch adapted to shut off operation of said winch at a predetermined point of travel of said canopy assembly relative to said hoist assembly.

* * * * *